US012085354B2

(12) United States Patent
D'Alfonso et al.

(10) Patent No.: US 12,085,354 B2
(45) Date of Patent: Sep. 10, 2024

(54) AMMUNITION CARRIER ASSEMBLY AND SYSTEM FOR A MACHINE GUN

(71) Applicant: Sig Sauer, Inc., Newington, NH (US)

(72) Inventors: Christopher B. D'Alfonso, Exeter, NH (US); Andrew P. Loriot, Somersworth, NH (US)

(73) Assignee: Sig Sauer, Inc., Newington, NH (US)

( * ) Notice: Subject to any disclaimer, the term of this patent is extended or adjusted under 35 U.S.C. 154(b) by 186 days.

(21) Appl. No.: 17/935,164

(22) Filed: Sep. 26, 2022

(65) Prior Publication Data

US 2024/0102755 A1 Mar. 28, 2024

(51) Int. Cl.
*F41A 9/79* (2006.01)
*F41A 9/29* (2006.01)

(52) U.S. Cl.
CPC ..... *F41A 9/29* (2013.01)

(58) Field of Classification Search
CPC .... F41A 9/79; F41A 9/29; F41A 25/12; F41A 33/00; F41A 9/34; F41A 9/62; F41A 11/02; F41C 23/04; F42B 39/26
USPC .... 89/34, 198, 33.16; 42/50, 6, 75.02, 75.01
See application file for complete search history.

(56) References Cited

U.S. PATENT DOCUMENTS 2,180,741 A * 11/1939 Lisov ..... F41A 9/78 42/6
2,557,441 A * 6/1951 Kornblum ..... F41A 9/51 89/33.5
3,293,986 A * 12/1966 Stoner ..... F41A 17/38 89/34
3,762,268 A * 10/1973 Gaye ..... F41A 9/80 89/34
4,066,000 A * 1/1978 Rostocil ..... F41A 9/79 89/34
4,484,403 A * 11/1984 Schwaller ..... F41A 9/63 42/50
4,715,141 A * 12/1987 Kohnke ..... F41A 9/60 42/98
4,939,979 A * 7/1990 Capawana ..... F41A 9/79 89/34

(Continued)

OTHER PUBLICATIONS evike.com, G&G CM16 LMG Airsoft AEG Light Machine Gun (Color: Tan), https://www.evike.com/products/95651/ (visited Aug. 31, 2022).

(Continued)

*Primary Examiner* — Michael D David
(74) *Attorney, Agent, or Firm* — Finch & Maloney PLLC

(57) ABSTRACT

An ammunition carrier assembly includes a first plate having a first portion and a second portion, where the first plate is folded so that the second portion faces the first portion and the second portion extends from a fold along part of the first portion. A second plate is configured to be fixedly attached to the first plate. The second plate has a planar portion and a hub that extends away from a face of the planar portion. The hub defines openings in opposite sides of the hub. The first plate is sized and configured to be installed on a panel of an ammunition container such that the panel and part of the second plate is between the first and second portions of the first plate. The assembly can be part of a system that includes a magazine well attached to a machine gun.

20 Claims, 6 Drawing Sheets

(56) References Cited

U.S. PATENT DOCUMENTS

| | | | | |
|---|---|---|---|---|
| 5,155,292 | A * | 10/1992 | Rostcil | F41A 25/22 89/169 |
| 5,206,454 | A * | 4/1993 | Sanderson | F41A 9/79 89/33.14 |
| 6,675,693 | B1 * | 1/2004 | Heayn | F41A 9/79 89/34 |
| 8,539,872 | B2 | 9/2013 | Moody | |
| 8,690,575 | B1 * | 4/2014 | Gurule | F41A 33/06 434/18 |
| 8,820,212 | B2 | 9/2014 | Rostocil | |
| 9,664,469 | B2 * | 5/2017 | DiChario | F41A 9/62 |
| 9,823,037 | B1 | 11/2017 | Lowrance | |
| 11,193,724 | B1 * | 12/2021 | McCarthy | F41C 23/10 |
| 2008/0092728 | A1 * | 4/2008 | Stussak | F41A 9/34 89/34 |
| 2010/0236394 | A1 * | 9/2010 | Gomez | F41A 19/46 89/138 |
| 2012/0048101 | A1 * | 3/2012 | Shirts | F41A 9/29 29/401.1 |
| 2016/0146563 | A1 * | 5/2016 | Garvis | F41A 9/29 434/16 |
| 2019/0331450 | A1 * | 10/2019 | Steimke | F41A 3/26 |

OTHER PUBLICATIONS

TFBTV, "The SIG LMG-68 Light Machine Gun: Next Gen Firepower", available at https://www.youtube.com/watch?v=LO0D9PD0Yns (Apr. 19, 2021).

* cited by examiner

AMMUNITION CARRIER ASSEMBLY AND SYSTEM FOR A MACHINE GUN

TECHNICAL FIELD

The present disclosure relates generally to ammunition magazines and carriers for firearm ammunition. More particularly, the present disclosure relates to an ammunition carrier assembly and system for a machine gun.

BACKGROUND

A machine gun is typically characterized by being configured for sustained automatic fire using belt-fed ammunition. The machine gun is commonly used as an infantry support weapon and often is fired from a bipod or from a fixed mount on a vehicle, for example. To mitigate overheating, the machine gun most typically has an open-bolt operation and quick-change barrels. To supply the high round count often fired through a machine gun, the ammunition is linked together with metal links that separate or disintegrate when the round is fed into the chamber. To reduce random movements in the belt of ammunition during firing, an ammunition box or ammunition drum magazine may be used.

SUMMARY

The present disclosure is directed to an ammunition carrier system for a machine gun, components and subassemblies of the ammunition carrier system, and a method for attaching an ammunition carrier to the bottom of a machine gun. In one example embodiment, an ammunition carrier subassembly includes a first plate that is folded upon itself to define first and second plate portions and a fold between these portions. The first plate can be installed on the top panel of an ammunition container such that the top panel of the container is between the first and second plate portions. The carrier also includes a second plate that can be fixedly attached both to the first plate and to the container. The second plate includes a hub or boss that extends upward from the planar portion of the plate. The hub is sized and configured to be received in a magazine well—or simulation thereof—mounted on the bottom of a machine gun. In one embodiment, the hub defines a recess or opening on opposite sides of the hub. Latches on the magazine well can extend into the openings when the hub is inserted. For example, a simulated magazine well can be attached to the bottom of a machine gun housing, where the simulated magazine well has spring-biased levers configured to engage the recesses or openings in the sides of the hub. To remove the magazine carrier, the user can squeeze together the levers to disengage the lever catches from the hub and allow the carrier to drop from the magazine well by gravity. The second plate of the carrier assembly can be used with the first plate and with an ammunition container sized and configured for any one of a variety of machine guns or the ammunition for a particular machine gun. As such, the second plate may be considered a universal structure for mounting an ammunition container to a machine gun.

An ammunition carrier system as disclosed herein enables the user to quickly reload a machine gun with belted ammunition. The reloading process may include removing a depleted ammunition container from the magazine well, inserting the hub of a full carrier assembly into the magazine well, and allowing levers on the magazine well to occupy the recesses or openings in sides of the hub. Once engaged, a free end of the belted ammunition can be loaded into the feed tray of the machine gun. Thus, in similar fashion to reloading a rifle that uses a box magazine, a depleted carrier can be removed from the machine gun and replaced from below the gun's housing with a loaded carrier that snaps into a magazine well or simulation thereof.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
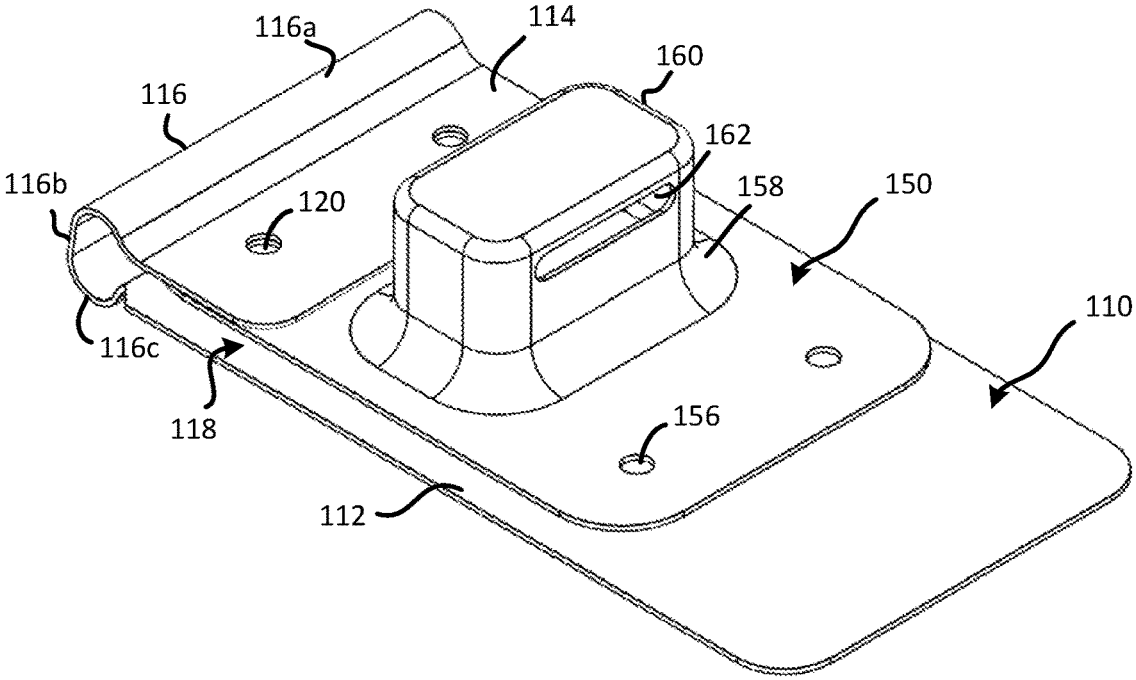
FIG. 1 is a top perspective view of first and second plates oriented in an assembled position, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is an ammunition carrier system and assembly. In accordance with one embodiment, the system includes a first plate having a first portion and a second portion, where the first plate is folded on itself to define a fold between the first portion and the second portion and so that the second portion faces the first portion and the second portion extends from the fold along part of the first portion. A second plate is configured to be fixedly attached to the first plate when installed on an ammunition container, such as using rivets. The second plate has a planar portion and a hub that extends away from a face of the planar portion. The first plate is sized and configured to be installed on a top panel of an ammunition container such that the top panel and part of the second plate is between the first and second portions of the first plate. For example, the first portion of the first plate is spaced from the second portion by a gap of 0.1-0.3 inch to accommodate the top panel of the container and part of the second plate. The assembly can be part of a system that includes a magazine well (or simulation thereof) that is attached to a machine gun. The hub is configured to be received in the magazine well and defines openings in opposite sides of the hub. When installed in the magazine well, catches extend into the openings to retain the carrier assembly with the magazine well.

The first and second plates can be provided as a stand-alone subassembly, as part of an ammunition carrier assembly or kit that includes a container, or as part of a system that includes the ammunition container and a magazine well configured to be secured to a machine gun. Numerous variations and embodiments will be apparent in light of the present disclosure.

Machine guns are adapted for continuous automatic fire and therefore can consume many rounds of ammunition. For this reason, it is not uncommon for the machine gun to feed ammunition that is linked together in belts of 100, 200, 500, 800, or more rounds. In some cases, the linked ammunition is provided without a package, such as when it is carried by hand. In other situations, the linked ammunition is fed to the machine gun from a box that is set on the ground. In some situations, the ammunition belt may exhibit unintended movement due to the action of the machine gun. To reduce this movement and to make the belted ammunition more manageable to handle, the ammunition may be packaged in a container that is placed next to the machine gun.

When the container is separate from the machine gun, a second person may be needed to stabilize the ammunition container when firing in order to prevent it from falling over and to prevent feed problems associated with twists or with a belt that is tangled with itself or with vegetation. One approach has been to attach an ammunition container to the side of a machine gun. Despite some improvement, non-trivial challenges remain.

In light of the foregoing, it would be desirable to attach the ammunition container to the machine gun, particularly to attach the container to the bottom of a machine gun similar to inserting a magazine into the magazine well of an automatic rifle. It would also be desirable that the ammunition container can be refilled with ammunition when depleted. The present disclosure addresses this need and others by providing an ammunition carrier assembly and system in which an ammunition container can be releasably attached to a magazine well (or simulation thereof) on the bottom of a machine gun. Such an approach advantageously reduces the distance from the container to the feed tray and in turn reduces movement of the ammunition belt. Also, attaching an ammunition container to the bottom of a machine gun, and removing it after it becomes depleted, are familiar actions to operators of semiautomatic and automatic rifles.

An ammunition carrier assembly and system disclosed herein can be used with a variety of machine guns and ammunition, including light and medium machine guns chambered for 7.56×51 mm, 0.30-06, 6.5 mm Remington SPC, and 0.338 Norma Magnum ammunition, to name a few examples.

It should be noted that, while generally referred to herein as a magazine well for consistency and ease of understanding the present disclosure, the disclosed magazine well is not a true magazine well in the sense that ammunition is loaded into the chamber via a magazine that extends through the magazine well to the chamber. Accordingly, the present disclosure is not limited to that specific terminology and alternatively can be referred to, for example, as an attachment well, a hub receiver, a simulated magazine well, or other terms. Also, while generally referred to herein as a hub, the disclosed hub can alternately be referred to as a boss, a protrusion, or other terms. Numerous configurations will be apparent in light of this disclosure.

EXAMPLE EMBODIMENTS

Figure 2:
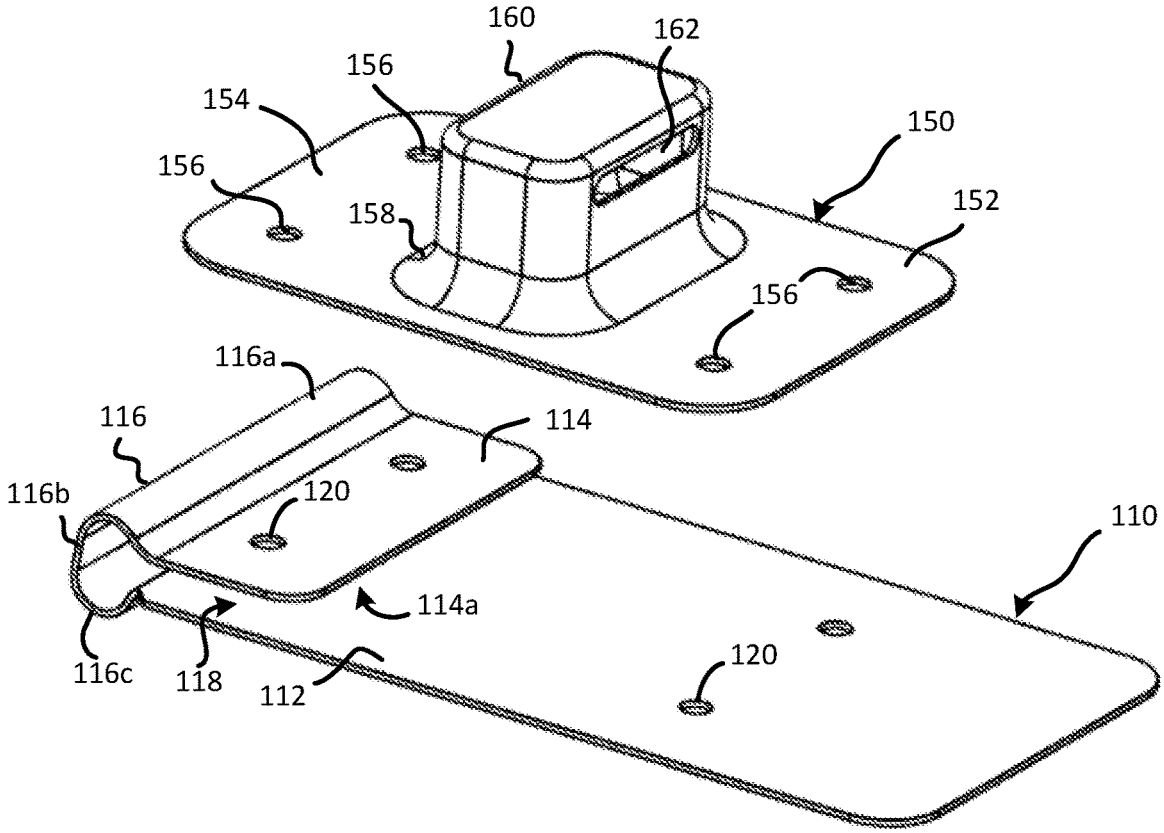
FIG. 2 is an exploded perspective view of the first and second plates of FIG. 1.
Figure 3:
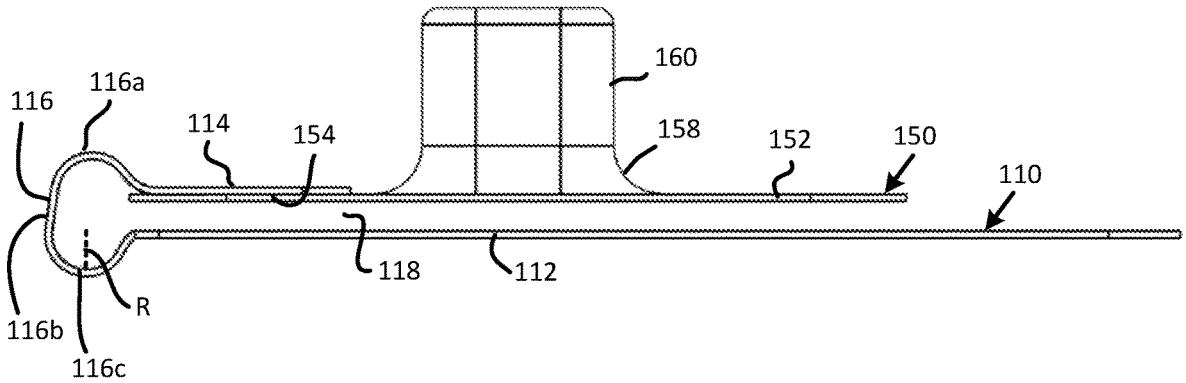
FIG. 3 is a side elevational view of the plates of FIG. 1.

FIGS. 1 and 2 illustrate top perspective views of a first plate and a second plate of an ammunition carrier assembly, in accordance with an embodiment of the present disclosure. In FIG. 1, the first plate 110 and the second plate 150 are oriented in an assembled position with an end portion 154 of the second plate 150 between a first portion 112 and second portion 114 of the first plate 110. For instance, the end portion 154 abuts the bottom face 114*a* of the second portion 114. FIG. 2 shows the first plate and the second plate separately. FIG. 3 illustrates a side view of the plates shown in FIG. 1.

The first plate 110 includes a first portion 112 and a second portion 114. The first plate 110 is folded so that the second portion 114 faces the first portion 112 and so that the second portion 114 extends from the fold 116 along part of the first portion 112. The fold 116 connects the first portion 112 to the second portion 114 and functions as an anti-snag feature for belted ammunition. In some embodiments, the fold 116 is rounded, at least in part, and has a vertical size from 0.5 to 1.0 inch, or about 0.75 inch. In one example, the top 116*a* of the fold 116 is rounded with a radius of curvature R of about 0.2 inch, the bottom 116*b* of the fold 116 is rounded with a radius of curvature R of about 0.2 inch, and these rounded portions are connected by a straight segment 116*c* of about 0.2-0.3 inch in length. In other embodiments, the fold 116 has a circular profile with a radius R of 0.225 to 0.5 inch. In some such embodiments, such as shown here, the fold 116 is larger in size than the gap 118 between the first and second portions 112, 114 of the first plate 110. The size of the fold 116 and rounded shape facilitates movement of belted ammunition from the ammunition container to the firearm by reducing the likelihood that ammunition snags on the edge of the container or the first plate 110. The radius of curvature R and overall profile of the fold 116 can be selected as needed to achieve this goal with a particular size of ammunition, as will be appreciated.

In this example, the second portion 114 is spaced from the first portion 112 by a gap 118 from 0.1-0.3 inch, such as about 0.2 inch. The gap 118 can be sized to accommodate part of the second plate 150 and a top panel of an ammunition container between the first and second portions 112, 114. Depending on the thickness of the second plate and the ammunition container panel, the gap 118 can be made smaller or larger as needed.

The first and second portions 112, 114 define a plurality of fastener openings 120. Fastener openings 120 of the second portion 114 are aligned with some of the fastener openings 120 (not visible) in the first portion 112.

The second plate 150 has a planar portion 152 that includes the end portion 154. The planar portion 152 defines a plurality of fastener openings 156, at least some of which align with fastener openings 120 in the first plate 110 when the first plate 110 and the second plate 150 are assembled. Thus, the second plate 150 can be fixedly attached to the first plate 110 (and to the ammunition container) using fasteners, such as rivets, screws, or other suitable fastener.

A hub 160 is connected to and extends away from (e.g., upward from) the planar portion 152. When the second plate 150 is made of steel, the hub 160 can be integrally formed as part of the second plate 150. In some embodiments, the hub 160 is centered within the planar portion 152, but this is not required in all embodiments. In this example, the hub 160 generally has a rectangular cross-sectional shape with rounded corners. Other geometries can be used, as will be appreciated. In this example, a transition region 158 connects the vertical walls of the hub 160 to the planar portion 152 of the second plate 150. In this example embodiment, the transition region 158 extends around all sides of the hub 160 and has a concave curvature. The transition region 158 can be shaped to mate with the corresponding surfaces of a magazine well 200, such as a flared magazine well entrance, when the hub 160 is installed in the magazine well 200. The transition region 158 is optional and can have other configurations or can be omitted.

Opposite sidewalls of the hub 160 define recesses or openings 162 that define a catch surface for the latch mechanism of the magazine well 200 (discussed below). For example, recesses extend inward into the material of the hub 160, defining a void to accept the latch mechanism. In another example, the hub is hollow, and the sidewalls of the hub define openings 162 to the void or the hollow inside of the hub. In either case, the latch mechanism can extend into the void or hollow interior of the hub 160 in the latched condition. When the latch mechanisms engage the recesses or openings 162 in the opposite sides of the hub 160, the magazine well 200 captures or retains the hub 160 it is until released.

In other embodiments, the hub 160 can have other structures configured to similarly engage the latch mechanisms of the magazine well 200. For example, the hub 160 can be a pair of vertical walls that define openings 162, where the vertical walls may be connected at their top ends by a cross piece as needed.

Figure 4:
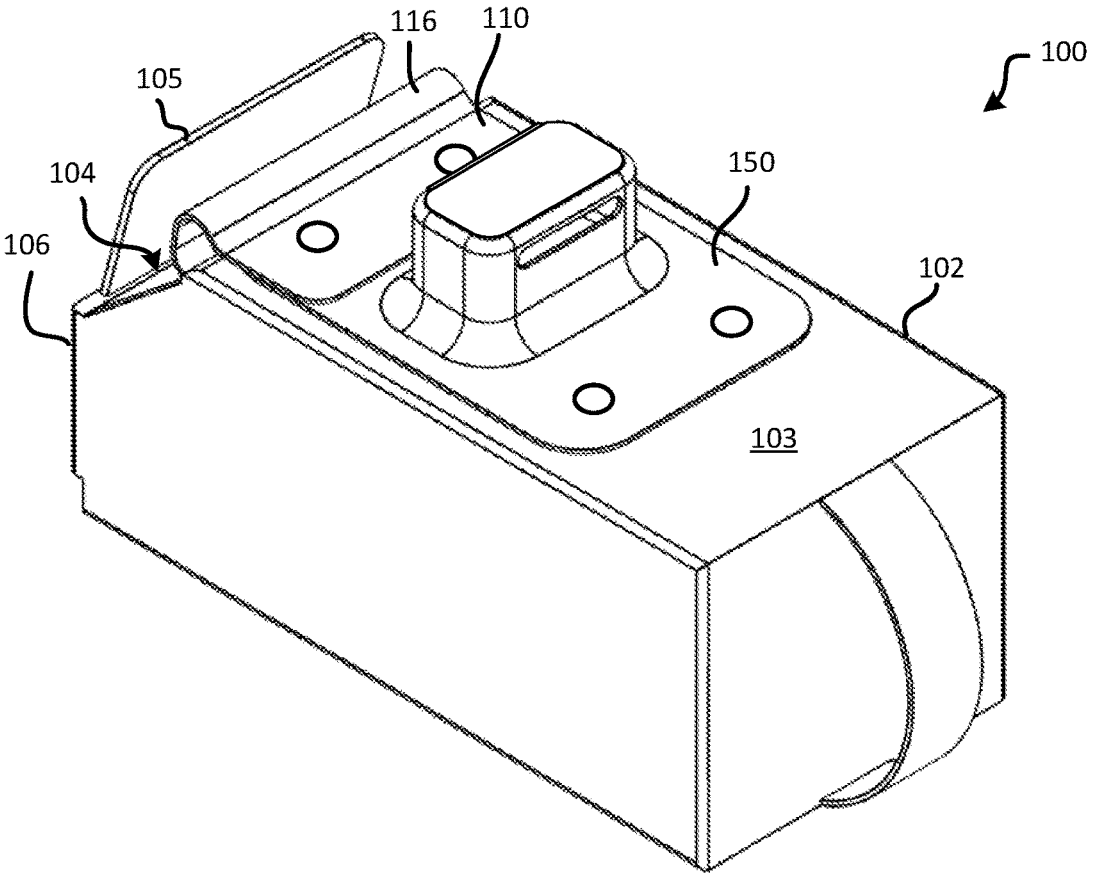
FIG. 4 is a top perspective view of an ammunition carrier assembly, in accordance with an embodiment of the present disclosure.
Figure 5:
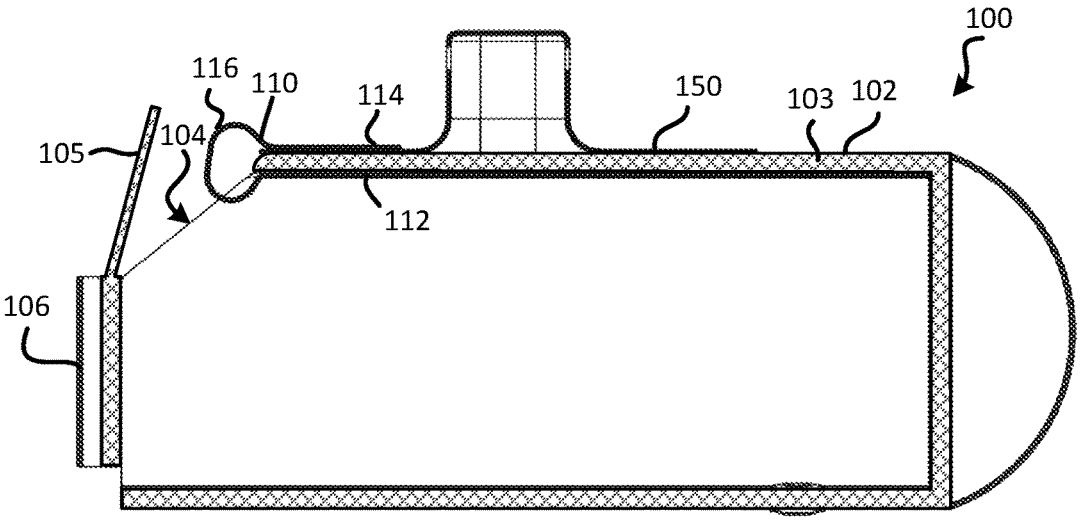
FIG. 5 is a front, cross-sectional view of the ammunition carrier assembly of FIG. 4.

FIG. 4 illustrates a top perspective view and FIG. 5 illustrates a front cross-sectional view of an ammunition carrier assembly 100 that includes an ammunition container 102 with the first plate 110 and second plate 150 mounted to the container 102, in accordance with an embodiment of the present disclosure. The ammunition container 102 has a box-like geometry that includes a top panel 103 and a removable front panel 106. The container 102 is sized to receive packaged or loose belted ammunition, including belted ammunition that is packaged in a cardboard box of 100 linked rounds, for example. At the front end, the container 102 defines an opening 104. The front panel 106 includes a flap 105 configured to guide ammunition as it is drawn from the container 102 through the opening 104. The container 102 can be made of rigid materials, such as metal, plastic, or a combination of these materials. The front panel 106 can be slidably removed from the container 102, or can be folded open (e.g., via a hinge), to enable loading the container 102 with belted ammunition, whether loose or packaged in a cardboard box, for example. In yet other embodiments, the front panel 106 can be fastened to the container 102 using clips, brackets, or fasteners. The first and second plates 110, 150 can be installed on the container 102 with the top panel 103 between the first portion 112 of the first plate 110 and the second plate 150. The plates 110, 150 can then be riveted or otherwise fastened to the top panel 103, thereby securing the plates 110, 150 and top panel 103 together. As best shown in FIG. 5, the flap 105 is spaced from the fold 116 to define a passageway for feeding ammunition from the container 102.

Figure 6:
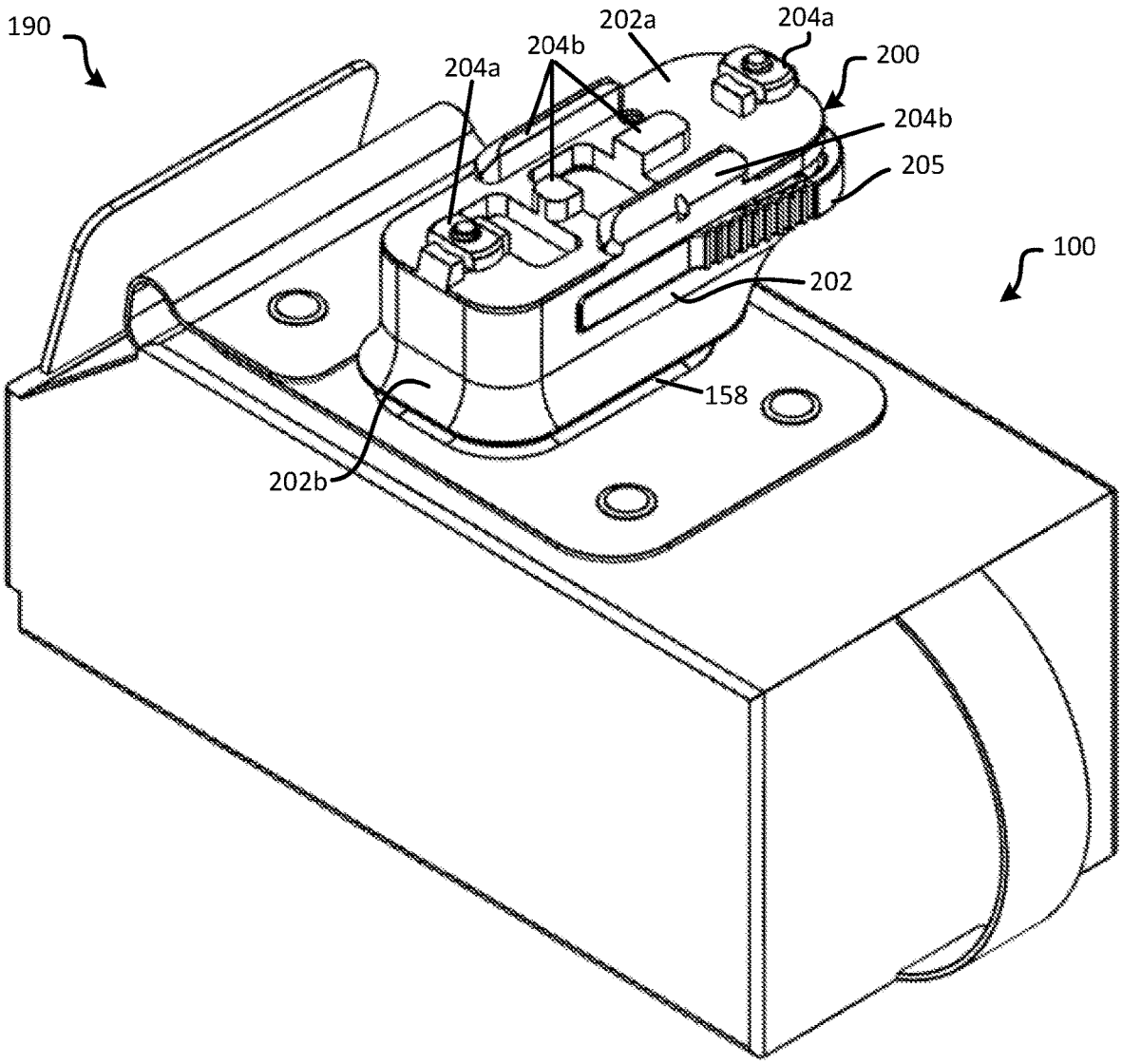
FIG. 6 is a top perspective view of components of an ammunition carrier system shown in an assembled form, in accordance with an embodiment of the present disclosure.

FIG. 6 illustrates a top perspective view of components of an ammunition carrier system 190 that includes an ammunition carrier assembly 100 and magazine well 200, in accordance with an embodiment of the present disclosure. The magazine well 200 includes a body 202 that defines a void sized and configured to receive the hub 160 on the second plate 150. A top 202*a* of the body 202 includes attachment features 204 for mounting the magazine well 200 to a bottom surface of a machine gun housing, receiver, or rail on the gun. For example, the attachment features 204 include elongated locking nuts 204*a* and protrusions 204*b* that can be received in elongated openings in a mounting rail on the firearm, where the locking nuts can be rotated to secure a component to the mounting rail. Some protrusions 204*b* extend along sides of a mounting rail and may be useful to stabilize the magazine well 200 and prevent rotation. One example of such a mounting system is the M-LOK system made by Magpul Industries. Another example is the KeyMod system made by Bravo Company. Yet another acceptable attachment system is a MIL-1911 or "Picatinny" rail and corresponding mounting hardware (e.g., brackets).

The magazine well 200 includes latches 205 on opposite lateral sides of the body 202. Each latch 205 is spring biased toward a latched position where part of the latch 205 protrudes into the void defined by the magazine well 200 and is positioned to engage, or engages, the opening 162 or recess in the hub 160. For example, each latch 205 pivots between a latched position and an unlatched position. To release the ammunition carrier assembly 100, the user can squeeze both latches 205 inward towards one another to move the latches 205 to the unlatched position and disengage the hub 160.

The magazine well 200 optionally defines a flared opening defined by a lower end portion 202*b* of the body 202 extending downward and outward in a linear or curved fashion. As shown in FIG. 6, the hub 160 (not visible) is received in the magazine well 200 with the flared lower end portion 202*b* mating with or adjacent to the curved transition region 158 of the hub 160.

Figure 7:
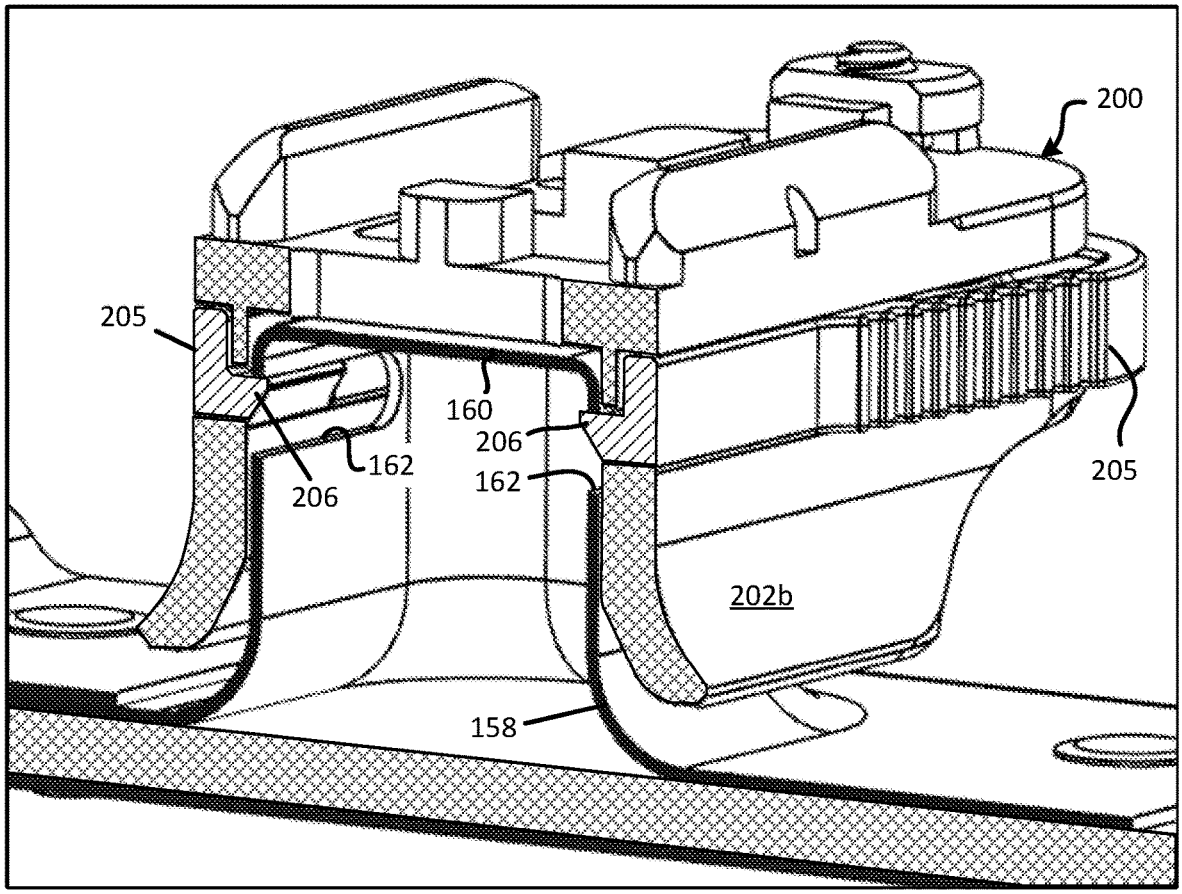
FIG. 7 is a rear, perspective, cross-sectional view showing components of the ammunition carrier system of FIG. 6, in accordance with an embodiment of the present disclosure.

FIG. 7 shows a rear perspective, cross-sectional view showing part of the assembly of FIG. 6. The hub 160 is received in the magazine well 200 with latch catches 206 extending into the openings 162 to retain the hub 160 to the magazine well 200. Accordingly, both latches 205 are in the latched position. The flared lower end portion 202*b* accommodates the curved transition region 158 of the hub 160.

Figure 8:
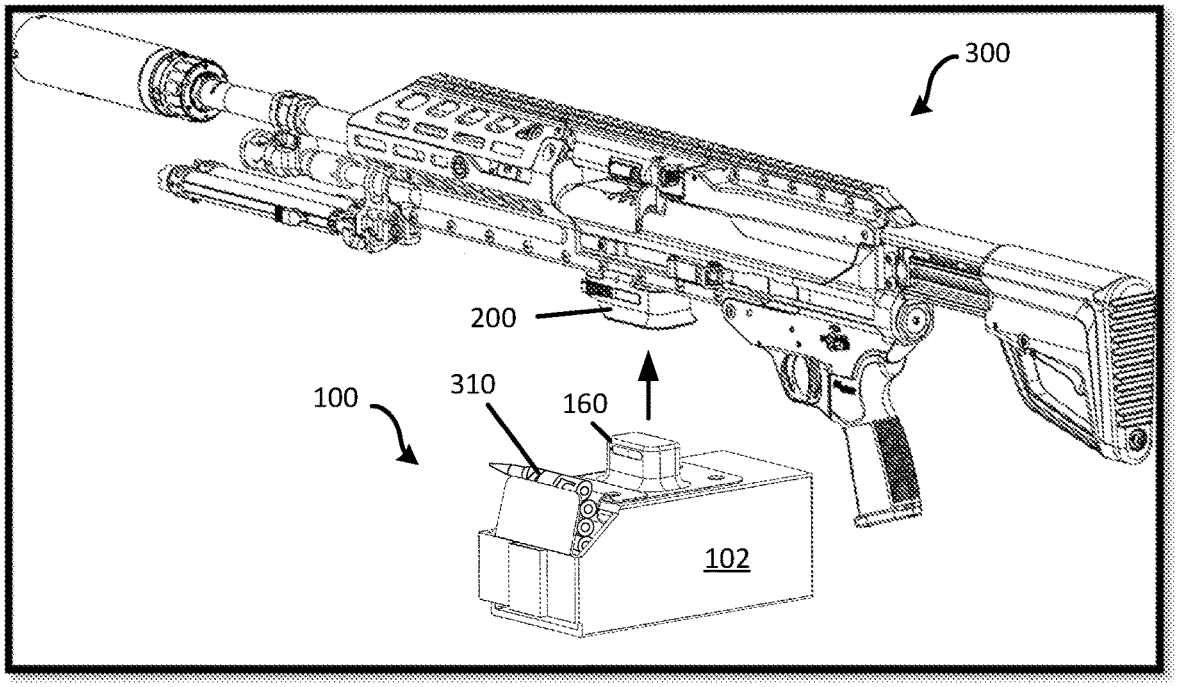
FIG. 8 is a rear perspective view of an ammunition carrier system in use with a machine gun, in accordance with an embodiment of the present disclosure.
Figure 9:
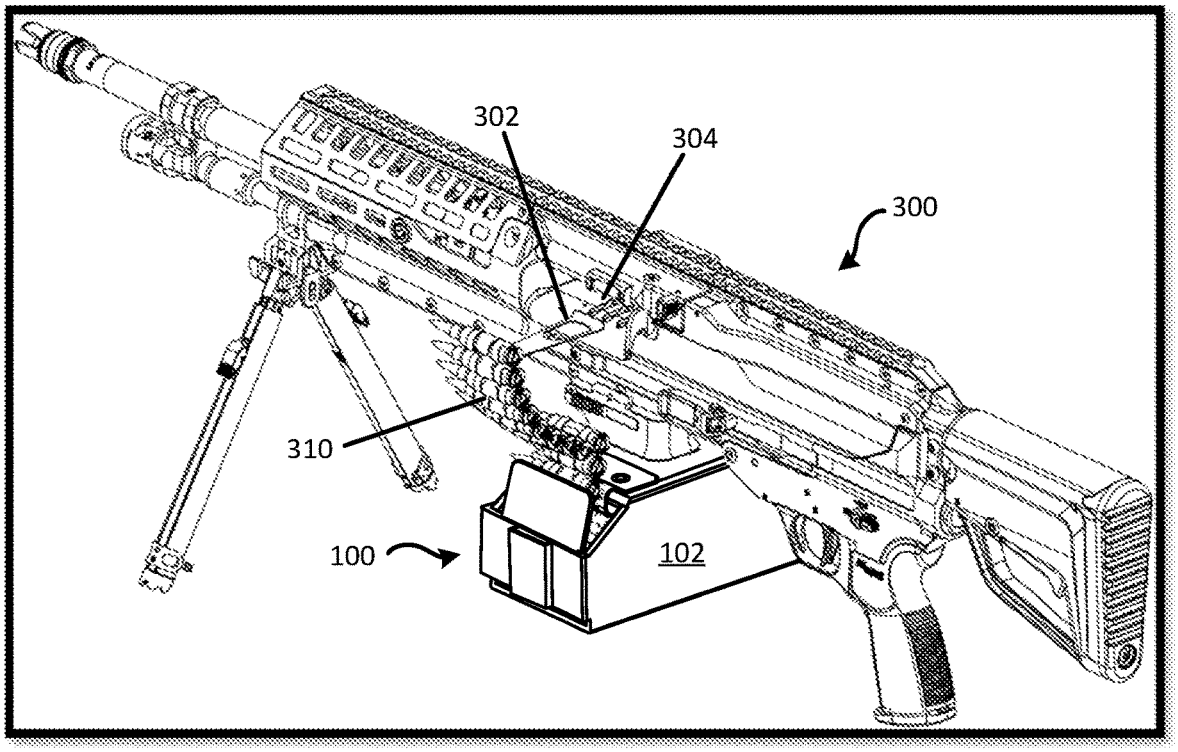
FIG. 9 is a rear perspective view of the ammunition carrier system of FIG. 8 shown with the ammunition carrier assembly attached to the bottom of the machine gun via a magazine well secured to the machine gun, in accordance with an embodiment of the present disclosure.

FIG. 8 shows a rear perspective view of a machine gun 300 with an ammunition carrier assembly 100 positioned for attachment to the magazine well 200, in accordance with an embodiment of the present disclosure. The hub 160 is aligned for insertion into the magazine well 200 and some of the ammunition 310 extends out of the container 102. The user can push the ammunition carrier assembly 100 into engagement with the magazine well 200, then can load the machine gun 300 with ammunition. FIG. 9 shows the machine gun 300 of FIG. 8 with the ammunition carrier assembly 100 engaged into the magazine well and ammunition 310 being loaded into the feed tray 304 of the machine gun 300 using a "spoon" 302.

In use, an ammunition carrier assembly 100 in accordance with the present disclosure enables the operator to attach a container 102 of ammunition 310 to the bottom of a machine gun 300 in similar fashion as accomplished with a magazine-fed rifle. For example, a 100-round box of ammunition is placed inside the container 102 that is part of an ammunition carrier assembly 100. In this process, some of the belted ammunition is positioned to extend through the opening 104 to facilitate loading the ammunition onto the feed tray. The ammunition carrier assembly 100 is moved upward to insert the hub 160 into the magazine well 200, which is attached to the bottom of a machine gun housing.

As the hub 160 of the assembly 100 is pushed into the magazine well 200, each latch catch 206 engages the openings 162 in the sides of the hub 160, retaining the assembly 100 with the machine gun 300. The machine gun 300 can then feed ammunition 310 from the container 102 located on the bottom of the machine gun housing below the feed tray. Due to the proximity of the container 102 to the feed tray 304, movement of the belted ammunition resulting from firing is reduced. After depleting the container 102 of ammunition, the user may squeeze together the latches 205 to disengage the latch catches 206 from the hub 160, thereby allowing the ammunition carrier assembly 100 to drop from the magazine well 200.

Since the second plate 150 with hub 160 is a separate structure from the first plate 110, the second plate 150 can be assembled with a first plate 110 and ammunition container 102 configured for ammunition of different sizes. In this way, the hub 160 is a universal point of attachment, unlike previous approaches where a single plate and hub were machined to fit a particular container or a particular firearm. The first and second plates can be made from steel sheet metal, which omits the need to reinforce the catch on a hub 160 made of aluminum or other soft metal.

FURTHER EXAMPLE EMBODIMENTS

The following examples pertain to further embodiments, from which numerous permutations and configurations will be apparent.

Example 1 is an ammunition carrier assembly that includes a first plate having a first portion and a second portion, wherein the first plate is folded to define a fold between the first portion and the second portion and so that the second portion faces the first portion and the second portion extends from the fold along part of the first portion. A second plate is configured to be fixedly attached to the first plate and includes a planar portion and a hub that extends away from a face of the planar portion. The hub defining openings in opposite sides of the hub. The first plate is sized and configured to be installed on a top panel of an ammunition container such that the top panel and part of the planar portion of the second plate is between the first and second portions of the first plate.

Example 2 includes the ammunition carrier assembly of Example 1, wherein the fold has a diameter of at least 0.3 inch.

Example 3 includes the ammunition carrier assembly of Example 2, wherein the diameter is at least 0.4 inch.

Example 4 includes the ammunition carrier assembly of Example 2, wherein the diameter is at least 0.5 inch.

Example 5 includes the ammunition carrier assembly of any one of Examples 1-4, wherein at least part of the fold is rounded. For example, all or part of the fold follows a circular contour.

Example 6 includes the ammunition carrier assembly of any one of Examples 1-5, wherein the first portion and the second portion of the first plate are spaced apart by a gap of 0.1 inch or more.

Example 7 includes the ammunition carrier assembly of Example 6, wherein the gap is from 0.1 to 0.3 inch.

Example 8 includes the ammunition carrier assembly of any one of the foregoing Examples and further includes the ammunition container. The ammunition container has a top panel and defines an opening at one end of the ammunition container.

Example 9 includes the ammunition carrier assembly of Example 8, wherein the first plate is installed on the top panel of the ammunition container with the top panel between the first portion and the second portion, the second plate is installed on the top panel of the ammunition container with part of the second plate between the top panel and the second portion of the first plate; wherein the first plate, the second plate, and the top panel are secured together with one or more fasteners.

Example 10 includes the ammunition carrier assembly of Example 9, wherein the first plate defines a plurality of first openings and the second plate defines a plurality of second openings aligned with the plurality of first openings, and the one or more fastener includes fasteners extending through at least two aligned first and second openings.

Example 11 includes the ammunition carrier assembly of Example 10, wherein the fasteners comprise rivets.

Example 12 includes the ammunition carrier assembly of any one of Examples 1-11, wherein the hub has a generally rectangular cross-sectional shape.

Example 13 includes the ammunition carrier assembly of Example 12, wherein the generally rectangular cross-sectional shape includes rounded corners.

Example 14 includes the ammunition carrier assembly of any one of Examples 1-13, wherein the first plate and the second plate are made of steel.

Example 15 includes the ammunition carrier assembly of any one of the foregoing examples and further includes a magazine well configured for removable attachment to a firearm. The magazine well defining a void and has a first latch on a first side and a second latch on a second side, the first latch and the second latch biased towards a latched position. The magazine well is configured to receive the hub of the second plate in the void, and when the hub is installed in the hub, the first latch and the second latch extend into the openings in the opposite sides of the hub.

Example 16 includes the ammunition carrier assembly of Example 15, wherein the magazine well is removably attached to a bottom of machine gun.

Example 17 is an ammunition carrier assembly that includes an ammunition container having a box-like shape with a top panel and defining an opening at one end of the ammunition container. A first plate has a first portion and a second portion, wherein the first plate is folded to define a fold between the first portion and the second portion and so that the second portion faces the first portion and the second portion extends from the fold along part of the first portion. The first plate defines a first plurality of fastener openings. A second plate is configured to be fixedly attached to the first plate and includes a planar portion and a hub that extends away from a face of the planar portion, the hub defining openings in opposite sides of the hub. The second plate defines a second plurality of fastener openings. The first plate is sized and configured to be installed on the top panel of the ammunition container such that the top panel and part of the planar portion of the second plate is between the first and second portions of the first plate, and when installed, at least some of the second plurality of fastener openings align with at least some of the first plurality of fastener openings.

Example 18 includes the ammunition carrier assembly of Example 17, wherein the first portion of the first plate is spaced from the second portion by a gap of at least 0.2 inch.

Example 19 includes the ammunition carrier assembly of Example 17 or 18 and further comprises a magazine well configured for removable attachment to a firearm and defining a void. The magazine well having a first latch on a first side and a second latch on a second side, where the first latch and the second latch biased towards a latched position. The magazine well is configured to receive the hub of the second plate in the void, and when the hub is installed in the hub, the first latch and the second latch extend into the openings in the opposite sides of the hub.

Example 20 includes the ammunition carrier assembly of Example 19, wherein the hub and the void each has a generally rectangular cross-sectional shape.

Example 21 includes the ammunition carrier assembly of any one of Examples 17-20, wherein the first plate is installed on the top panel of the ammunition container with the top panel and part of the second plate between the first and second portions of the first plate, and when installed at least some of the second plurality of fastener openings align with at least some of the first plurality of fastener openings, and wherein the ammunition carrier further comprises fasteners extending through at least some of the first plurality of fastener openings, at least some of the second plurality of openings, and the top panel of the ammunition container.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An ammunition carrier assembly, the ammunition carrier comprising:

a first plate having a first portion and a second portion, wherein the first plate is folded to define a fold between the first portion and the second portion and so that the second portion faces the first portion and the second portion extends from the fold along part of the first portion; and a second plate configured to be fixedly attached to the first plate and including a planar portion, the second plate including a hub that extends away from a face of the planar portion, the hub defining openings in opposite sides of the hub;

wherein the first plate is sized and configured to be installed on a top panel of an ammunition container such that the top panel and part of the second plate is between the first and second portions of the first plate.

2. The ammunition carrier assembly of claim 1, wherein at least part of the fold is rounded.

3. The ammunition carrier assembly of claim 1, wherein the fold has a diameter of at least 0.3 inch.

4. The ammunition carrier assembly of claim 3, wherein the first portion and the second portion of the first plate are spaced apart by a gap of 0.1 inch or more.

5. The ammunition carrier assembly of claim 4, wherein the gap is from 0.1 to 0.3 inch.

6. The ammunition carrier assembly of claim 1 further comprising the ammunition container, the ammunition container having a top panel and defining an opening at one end of the ammunition container.

7. The ammunition carrier assembly of claim 6, wherein the first plate is installed on the top panel of the ammunition container with the top panel between the first portion and the second portion, the second plate is installed on the top panel of the ammunition container with part of the second plate between the top panel and the second portion of the first plate.

8. The ammunition carrier assembly of claim 7, wherein the first plate, the second plate, and the top panel are secured together with fasteners.

9. The ammunition carrier assembly of claim 7, wherein the first plate defines a plurality of first openings and the second plate defines a plurality of second openings aligned with the plurality of first openings, and wherein the ammunition carrier assembly includes fasteners extending through at least two aligned first and second openings and the top panel.

10. The ammunition carrier assembly of claim 9, wherein the fasteners comprise rivets.

11. The ammunition carrier assembly of claim 1, wherein the hub has a generally rectangular cross-sectional shape.

12. The ammunition carrier assembly of claim 11, wherein the generally rectangular cross-sectional shape includes rounded corners.

13. The ammunition carrier assembly of claim 1, wherein the first plate and the second plate are made of steel.

14. The ammunition carrier of claim 1, further comprising a magazine well configured for removable attachment to a firearm, the magazine well defining a void and having a first latch on a first side and a second latch on a second side, the first latch and the second latch biased towards a latched position with a part of the latch extending into the void, wherein the magazine well is configured to receive the hub of the second plate in the void, and when the hub is installed in the hub, the first latch and the second latch extend into the openings in the opposite sides of the hub.

15. The ammunition carrier of claim 14, further comprising a machine gun, wherein the magazine well is removably attached to a bottom of the machine gun.

16. An ammunition carrier assembly, the ammunition carrier comprising:

an ammunition container having a box-like shape with a top panel and defining an opening at one end of the ammunition container;

a first plate having a first portion and a second portion, wherein the first plate is folded to define a fold between the first portion and the second portion and so that the second portion faces the first portion and the second portion extends from the fold along part of the first portion, the first plate defining a first plurality of fastener openings; and a second plate configured to be fixedly attached to the first plate and including a planar portion, the second plate including a hub that extends away from the planar portion, the hub defining openings in opposite sides of the hub, the planar portion defining a second plurality of fastener openings;

wherein the first plate is sized and configured to be installed on the top panel of the ammunition container such that the top panel and part of the planar portion of the second plate are between the first and second portions of the first plate, and when installed at least some of the second plurality of fastener openings align with at least some of the first plurality of fastener openings.

17. The ammunition carrier assembly of claim 16, wherein the first portion of the first plate is spaced from the second portion by a gap of at least 0.2 inch.

18. The ammunition carrier of claim 16, further comprising a magazine well configured for removable attachment to a firearm and defining a void, the magazine well having a first latch on a first side and a second latch on a second side, the first latch and the second latch biased towards a latched position, wherein the magazine well is configured to receive the hub of the second plate in the void, and when the hub is installed in the hub, the first latch and the second latch extend into the openings in the opposite sides of the hub.

19. The ammunition carrier of claim 18, wherein the hub and the void each has a generally rectangular cross-sectional shape.

20. The ammunition carrier of claim 16, wherein the first plate is installed on the top panel of the ammunition container with the top panel and part of the second plate between the first and second portions of the first plate, and when installed at least some of the second plurality of fastener openings align with at least some of the first plurality of fastener openings, and wherein the ammunition carrier further comprises fasteners extending through at least some of the first plurality of fastener openings, at least some of the second plurality of openings, and the top panel of the ammunition container.

* * * * *